US008500422B2

(12) United States Patent
Dowdeswell et al.

(10) Patent No.: US 8,500,422 B2
(45) Date of Patent: Aug. 6, 2013

(54) VACUUM PUMP

(75) Inventors: Stephen Dowdeswell, Cuckfield (GB); Nigel Paul Schofield, Horsham (GB); Peter Hugh Birch, Horsham (GB)

(73) Assignee: Edwards Limited (GB)

( * ) Notice: Subject to any disclaimer, the term of this patent is extended or adjusted under 35 U.S.C. 154(b) by 801 days.

(21) Appl. No.: 12/311,513

(22) PCT Filed: Oct. 1, 2007

(86) PCT No.: PCT/GB2007/050595
§ 371 (c)(1),
(2), (4) Date: Jan. 5, 2010

(87) PCT Pub. No.: WO2008/044064
PCT Pub. Date: Apr. 17, 2008

(65) Prior Publication Data

US 2010/0119399 A1 May 13, 2010

(30) Foreign Application Priority Data

Oct. 11, 2006 (GB) ..... 0620144.6

(51) Int. Cl.
*F03C 2/00* (2006.01)

(52) U.S. Cl.
USPC ..... 418/9; 418/149

(58) Field of Classification Search
USPC ..... 418/9, 10, 83, 149; 417/244, 199.1
See application file for complete search history.

(56) References Cited

U.S. PATENT DOCUMENTS 5,816,782 A * 10/1998 Nagayama et al. ..... 417/410.4
6,123,526 A * 9/2000 Chen et al. ..... 418/9
6,572,351 B2 * 6/2003 Durand et al. ..... 418/9
6,776,586 B2 * 8/2004 Naito et al. ..... 417/244
7,214,041 B2 * 5/2007 Birch et al. ..... 418/9
2002/0179284 A1 * 12/2002 Joshi et al. ..... 165/80.3
2003/0077182 A1 4/2003 Naito et al.
2005/0089424 A1 4/2005 Liu et al.

FOREIGN PATENT DOCUMENTS

EP 0 272 767 A2 6/1988
EP 0 272 767 A3 6/1988
EP 1 150 015 A2 10/2001
EP 1 150 015 A3 10/2001
EP 1 519 045 A2 3/2005
WO WO 2004/083643 A1 9/2004

OTHER PUBLICATIONS

United Kingdom Search Report of Application No. GB 0620144.6 mailed Dec. 21, 2006; Claims searched: 1; Date of Search: Dec. 20, 2006.

(Continued)

*Primary Examiner* — Hoang Nguyen
(74) *Attorney, Agent, or Firm* — Shumaker & Sieffert, P.A.

(57) ABSTRACT

A vacuum pump housing comprises first (12) and second half-shell stator components (14) defining a plurality of pumping chambers separated by partition members (26, 28, 30, 32). Each pumping chamber comprises an inlet port (42, 44, 46, 48, 50) for receiving fluid and an outlet port (54, 56, 58, 60, 62) through which pumped fluid is exhausted from the chamber. The inlet ports are open on an external surface of the first stator component, and the outlet ports are open on an opposing external surface of the second stator component. The stator components further define transfer channels (66, 68, 70, 72) for conveying fluid between the pumping chambers. Each transfer channel preferably comprises first and second portions located on opposite sides of the housing.

27 Claims, 6 Drawing Sheets

OTHER PUBLICATIONS

United Kingdom Search Report of Application No. GB 0620144.6 mailed May 23, 2007; Claims searched: 20; Date of search: May 22, 2007.
United Kingdom Search Report of Application No. GB 0620144.6 mailed May 23, 2007; Claims searched: 6; Date of search: May 22, 2007.
PCT Invitation to Pay Additional Fees of International Application No. PCT/GB2007/050595; Date of mailing: Feb. 12, 2008.
PCT International Search Report of International Application No. PCT/GB2007/050595; Date of mailing of the International Search Report: May 2, 2008.
PCT Written Opinion of the International Searching Authority of International Application No. PCT/GB2007/050595; Date of mailing: May 2, 2008.
PCT/ISA/220 Form of PCT/GB2007/050595, date of mailing: May 2, 2008.

* cited by examiner

VACUUM PUMP

FIELD OF THE INVENTION

The present invention relates to a vacuum pump housing, and in particular to a vacuum pump housing comprising first and second half-shell stator components defining a plurality of pumping chambers.

BACKGROUND OF THE INVENTION

A multistage vacuum pump generally comprises a pair of shafts each supporting plurality of rotor components. The shafts are located within a housing providing a stator for the pump. The housing comprises a gas inlet, a gas outlet and a to plurality of pumping chambers, with adjacent pumping chambers being separated by a partition member, generally in the form of a transverse wall. Fluid transfer channels connect the pumping chambers together.

Each pumping chamber houses a pair of Roots rotor components to provide a pumping stage of the pump. Each pair of rotor components is housed within a respective pumping chamber such that there is a small clearance between the rotor components and between each rotor component and an inner wall of the pumping chamber.

It is known, for example, from U.S. Pat. No. 6,572,351, EP 1,398,507 and US Patent Publication No. 2003/0133817, to form the housing of such a multistage vacuum pump from two half-shell stator components, which define the plurality of pumping chambers and the fluid transfer channels for conveying gas between the pumping chambers. In U.S. Pat. No. 6,572,351 and EP 1,398,507, the transfer channels are located within the partition members serving to separate adjacent pumping chambers, which has the effect of increasing the thickness of the partition members and thus undesirably increasing the overall length of the pump. In US 2003/0133817, the transfer channels extend circumferentially around the pumping chambers and partition members to connect adjacent pumping chambers together. However, this makes the transfer channels prone to blockage during manufacture, for example during a casting process.

SUMMARY OF THE INVENTION

The present invention provides a vacuum pump housing present invention provides a vacuum pump housing comprising first and second half-shell stator components defining a plurality of pumping chambers separated by partition members, each pumping chamber comprising an inlet port for receiving fluid and an outlet port through which pumped fluid is exhausted from the chamber, and transfer channels for conveying fluid between the pumping chambers, wherein the inlet ports are open on an external surface of the first stator component, the outlet ports are open on an opposing external surface of the second stator component, and each transfer channel extends within the stator components from a respective outlet port to a respective inlet port.

The present invention provides a vacuum pump housing present invention provides a vacuum pump housing comprising first and second half-shell stator components defining a plurality of pumping chambers separated by partition members, each pumping chamber comprising an inlet port for receiving fluid and an outlet port through which pumped fluid is exhausted from the chamber, and transfer channels for conveying fluid between the pumping chambers, wherein the inlet ports are open on an external surface of the first stator component, the outlet ports are open on an opposing external surface of the second stator component, and each transfer channel is located at least partially to the side of a respective pumping chamber, the inlet ports and exhaust ports being shaped to respectively receive fluid from, and convey fluid into, the transfer channels.

BRIEF DESCRIPTION OF THE DRAWINGS

The present invention will now be described, by way of present invention will now be described, by way of is example only, with reference to the accompanying drawings, in which.

DETAILED DESCRIPTION OF THE INVENTION

Figure 1:
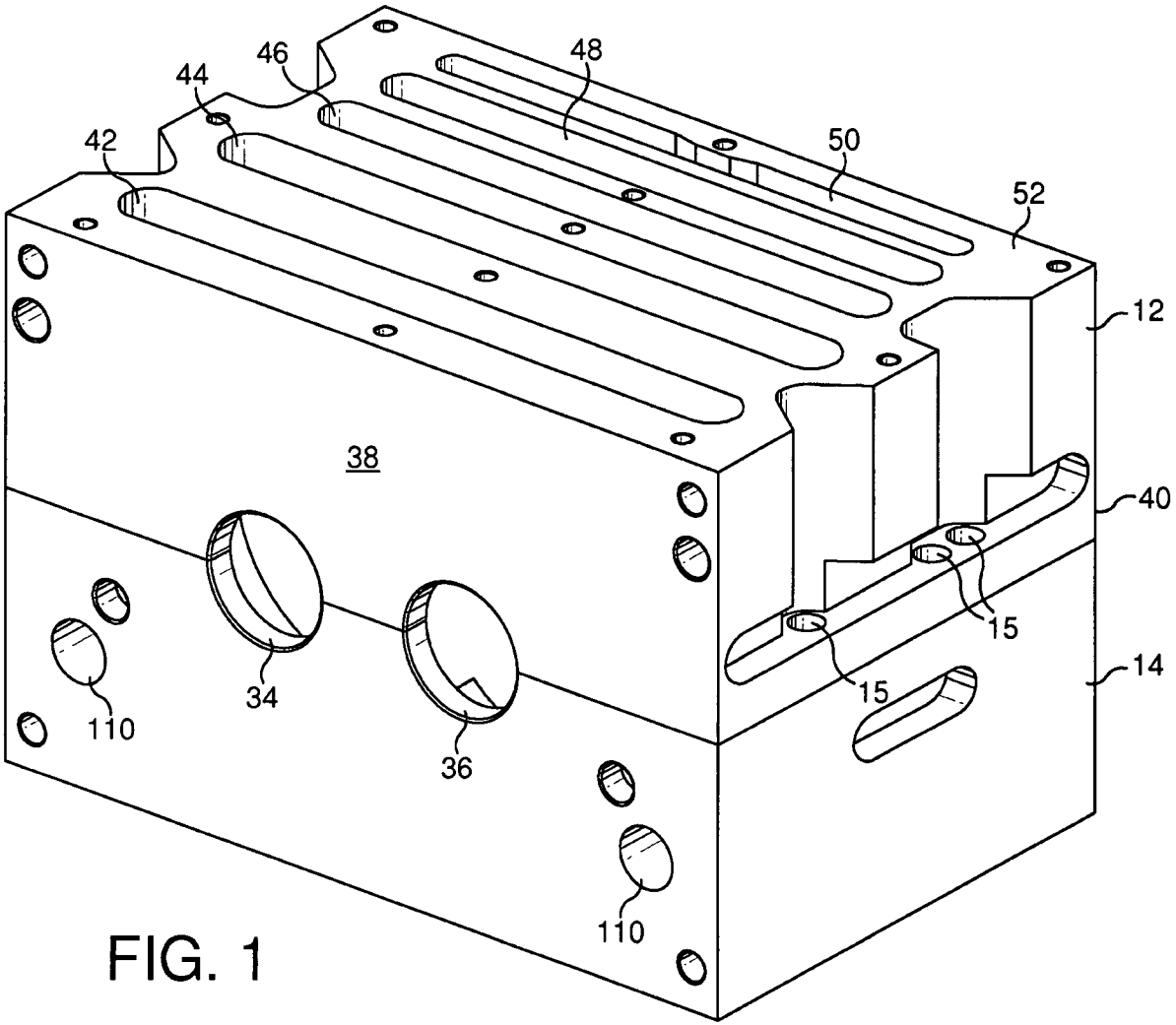
FIG. 1 is an isometric view of part of a vacuum pump housing.

The present invention provides a vacuum pump housing comprising first and second half-shell stator components defining a plurality of pumping chambers separated by partition members, each pumping chamber comprising an inlet port for receiving fluid and an outlet port through which pumped fluid is exhausted from the chamber, and transfer channels for conveying fluid between the pumping chambers, wherein the inlet ports are open on an external surface of the first stator component, the outlet ports are open on an opposing external surface of the second stator component, and each transfer channel extends within the stator components from a respective outlet port to a respective inlet port.

Open inlet and outlet ports on opposing external surfaces of the stator components enables the stator components to be manufactured using one of a range of different techniques, such as machining or casting, and can enable the ports and transfer channels to be easily cleaned.

Each transfer channel preferably comprises first and second portions located on opposite sides of the housing. Each transfer channel may extend from one of the external surfaces of the stator components to the other, thereby to facilitate manufacture and cleaning of the channels. In a housing in which each transfer channel is to the side of a respective pumping chamber, each transfer channel may extend substantially orthogonally between these two external surfaces or diagonally between these two external surfaces, for example at an angle of around 30° to the external surfaces, depending on the spacing between the pumping chambers.

Each transfer channel is preferably located at least partially to the side of at least one pumping chamber. This can enable the overall length of the pump to be reduced in comparison to prior pumps in which the transfer channels extend through the partition members separating the pumping chambers. For example, each transfer channel may extend diagonally sideways of two adjacent pumping chambers, and thus to the side of the partition member separating those pumping chambers. In another example, each transfer channel may be to the side of, and preferably co-planar with, a respective pumping chamber, with the inlet ports and exhaust ports being shaped to respectively receive fluid from, and convey fluid into, the transfer channels.

The present invention provides a vacuum pump housing comprising first and second half-shell stator components defining a plurality of pumping chambers separated by partition members, each pumping chamber comprising an inlet port for receiving fluid and an outlet port through which pumped fluid is exhausted from the chamber, and transfer channels for conveying fluid between the pumping chambers, wherein the inlet ports are open on an external surface of the first stator component, the outlet ports are open on an opposing external surface of the second stator component, and each transfer channel is located at least partially to the side of a respective pumping chamber, the inlet ports and exhaust ports being shaped to respectively receive fluid from, and convey fluid into, the transfer channels.

In a housing in each transfer channel is to the side of, and preferably co-planar with a respective pumping chamber, each transfer channel may arranged to convey fluid to the inlet port of its respective pumping chamber, with the outlet ports being shaped to convey fluid into the transfer channels. To enable the outlet ports to convey fluid into the transfer channels, each outlet port preferably comprises a first portion for receiving pumped fluid from its respective pumping chamber, and at least one second portion, extending at an angle to the first portion, for conveying pumped fluid to a respective transfer channel. Thus, if the transfer channels comprise two portions on opposite sides of the pumping chambers, the outlet ports may have a herringbone-type shape. In order to accommodate for variations in the size of the pumping chambers, each outlet port may have a respective different shape. For example, the outlet ports may have different respective angles between the first and second portions thereof. The inlet ports may have substantially the same shape, and preferably comprise slots arranged substantially parallel to the pumping chambers.

As an alternative, each transfer channel may be arranged to receive fluid from the outlet port of its respective pumping chamber, with the inlet ports being shaped to receive fluid from the transfer channels. Each inlet port may comprise a first portion from which fluid enters its respective pumping chamber, and at least one second portion, extending at an angle to the first portion, for receiving fluid from a respective transfer channel. Again, if the transfer channels comprise two portions on opposite sides of the pumping chambers, the inlet ports may have a herringbone-type shape. In order to accommodate for variations in the size of the pumping chambers, each inlet port may have a respective different shape. For example, the inlet ports may have different respective angles between the first and second portions thereof. The outlet ports may have substantially the same shape, and preferably comprise slots arranged substantially parallel to the pumping chambers. As another alternative, both the inlet and outlet ports may have substantially the same shape, and may both comprise slots arranged substantially parallel to the pumping chambers, with the transfer channels extending diagonally from the outlet port of one pumping chamber to the inlet port of another pumping chamber.

The inlet ports may be closed by a first cover plate mounted on the external surface of the first stator component, and the outlet ports may be closed by a second cover plate mounted on the external surface of the second stator component.

It is known to cool multistage vacuum pumps using water passing through channels in the stator. In order to provide a more compact and lower weight pump, it is desirable to remove these channels, and to cool the pump using water pipes clamped to large parts of the external surface of the pump housing to remove heat from the pump. However, a problem with this cooling technique is that the centre of the pump is not well cooled.

In view of this, in the preferred embodiment at least one of the cover plates comprises a plurality of sets of cooling fins, each set protruding into a respective port to contact fluid passing through the pump. The cover plate can thus perform the dual role of closing a plurality of ports, and providing an internal intercooling system for cooling fluid as it is conveyed between the pumping chambers. The fin area, fin shape, fin spacing and/or number of fins of each set may be individually configured to optimise the cooling at each port.

The present invention provides a vacuum pump housing comprising first and second half-shell stator components defining a plurality of pumping chambers separated by partition members, each pumping chamber comprising an inlet port for receiving fluid and an outlet port through which pumped fluid is exhausted from the chamber, and transfer channels for conveying fluid between the pumping chambers, wherein the inlet ports are open on an external surface of the first stator component, and the outlet ports are open on an opposing external surface of the second stator component, the ports being closed by cover plates mounted on said surfaces, at least one of the cover plates comprising a plurality of sets of cooling fins, each set protruding into a respective port to contact fluid passing through the pump.

The fins preferably have a length extending substantially parallel to the direction of fluid flow within the port. For example, for insertion into inlet or outlet ports extending substantially parallel to the pumping chambers, the cooling fins preferably also extend substantially parallel to the pumping chambers. This can present a relatively large surface area in the direction of flow of the fluid within the port, and thereby maximise heat transfer from the fluid to the fins.

Cooling fins may be provided on one of the covers plates, with each set of cooling fins protruding into a respective inlet port, or into a respective outlet port, or on both cover plates.

Means may be provided for removing from the cover plate the heat transferred to the fins by the fluid. For example, one or more water pipes may be mounted on the external surface of the cover plate to convey a coolant along or about the cover plate for receiving heat from the fins. Grooves may be formed in the cover plate to receive the water pipes.

Features described above in connection with the first aspect of the invention are equally applicable to the second and third aspects, and vice versa.

With reference to FIGS. 1 to 6, a vacuum pump housing 10 comprises a first half-shell stator component 12 and second half-shell stator component 14 which together form the main body of the housing 10. The stator components 12, 14 are assembled together by means of bolts or other fixing members inserted into assembly holes 15.

The stator components 12, 14 are machined, cast or otherwise formed to define a plurality of pumping chambers within the housing 10. In this example, the housing 10 is for a five stage vacuum pump, and comprises five pumping chambers 16, 18, 20, 22 and 24 separated by partition members in the form of transverse walls 26, 28, 30 and 32. These transverse walls are preferably integral with the stator components 12, 14.

Apertures 34, 36 are provided in the housing 10 each for receiving a respective drive shaft (not shown) of a rotor assembly of the vacuum pump. A plurality of Roots rotor components are mounted on, or integral with, the drive shafts so that each pumping chamber houses a pair of complementary rotor components to provide a pumping stage of the pump. Head plates (not shown) are mounted on the end surfaces 38, 40 of the stator components 12, 14 to seal the ends of the stator components 12, 14.

Each pumping chamber 16, 18, 20, 22, 24 comprises a respective inlet port 42, 44, 46, 48, 50 for receiving fluid to be pumped by that pumping chamber. As illustrated in the figures, the inlet ports are open on the top (as illustrated) external surface 52 of the first stator component 12. Each pumping chamber 16, 18, 20, 22, 24 also comprises a respective outlet port 54, 56, 58, 60, 62 through which pumped fluid is exhausted from the chamber. As illustrated in the figures, the outlet ports are open on the bottom (as illustrated) external surface 64 of the second stator component 14.

The stator components 12, 14 also define transfer channels 66, 68, 70 and 72 for conveying fluid between the pumping chambers. Each of the transfer channels is located to the side of, preferably co-planar with, a respective pumping chamber, and is configured to receive fluid from the outlet port of the pumping chamber located immediately upstream from its respective pumping chamber, and to convey fluid to the inlet port of its respective pumping chamber. For example, transfer channel 66 is located to the side of pumping chamber 18, and is configured to receive fluid from the outlet port 54 of pumping chamber 16 and to convey fluid to the inlet port 44 of pumping chamber 18, transfer channel 68 is located to the side of pumping chamber 20, and is configured to receive fluid from the outlet port 56 of pumping chamber 18 and to convey fluid to the inlet port 46 of pumping chamber 20, and so on.

Figure 5:
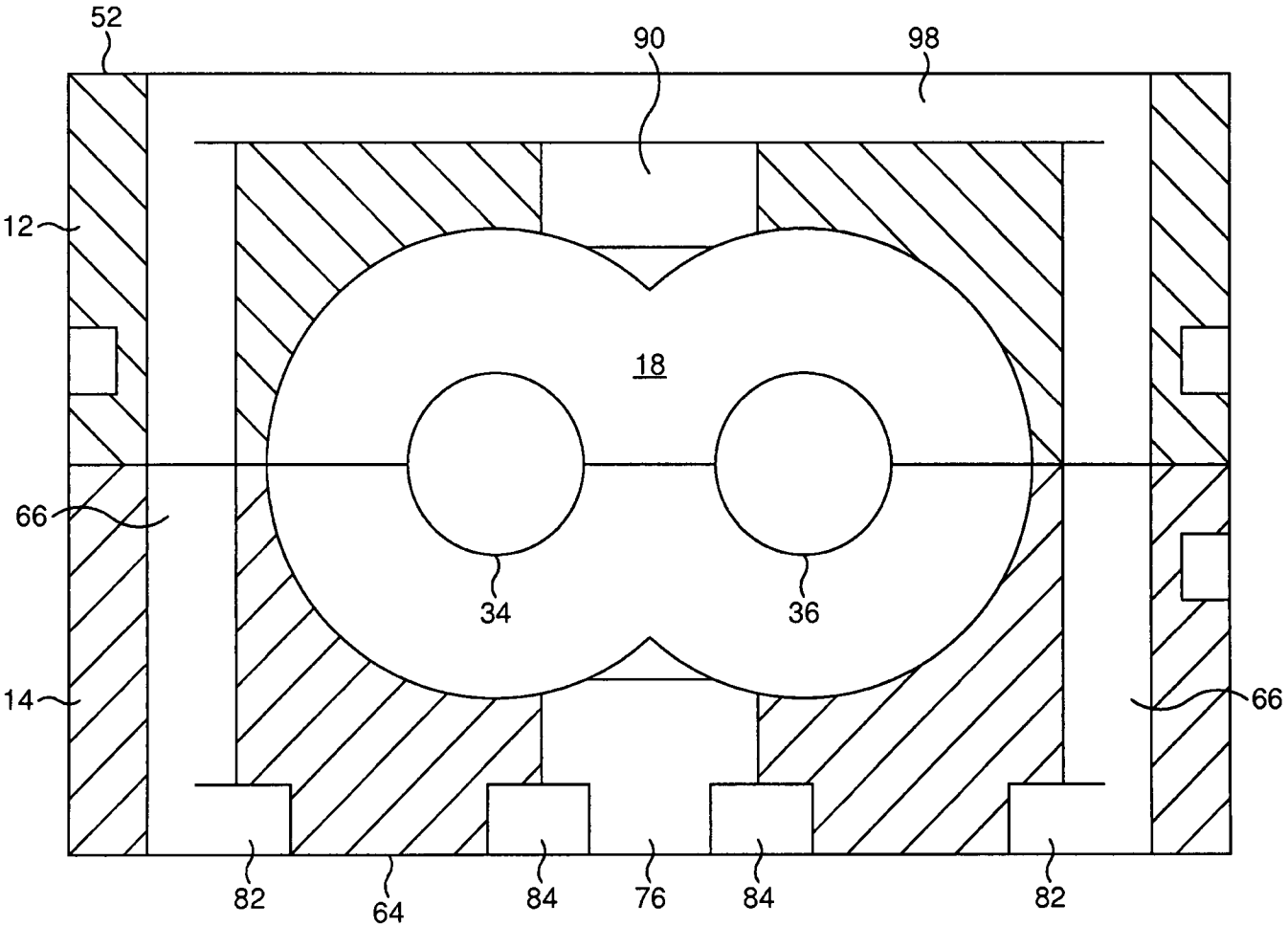
FIG. 5 is a sectional view along line D-D on FIG. 4.

In this example, each transfer channel comprises two portions located on opposite sides of the housing, and thus on opposite sides of its respective pumping chamber. As illustrated in FIG. 5, each transfer channel extends, preferably substantially orthogonally, between the opposing external surfaces 52, 64 of the stator components 12, 14 to facilitate manufacture and cleaning of the transfer channels.

Figure 2:
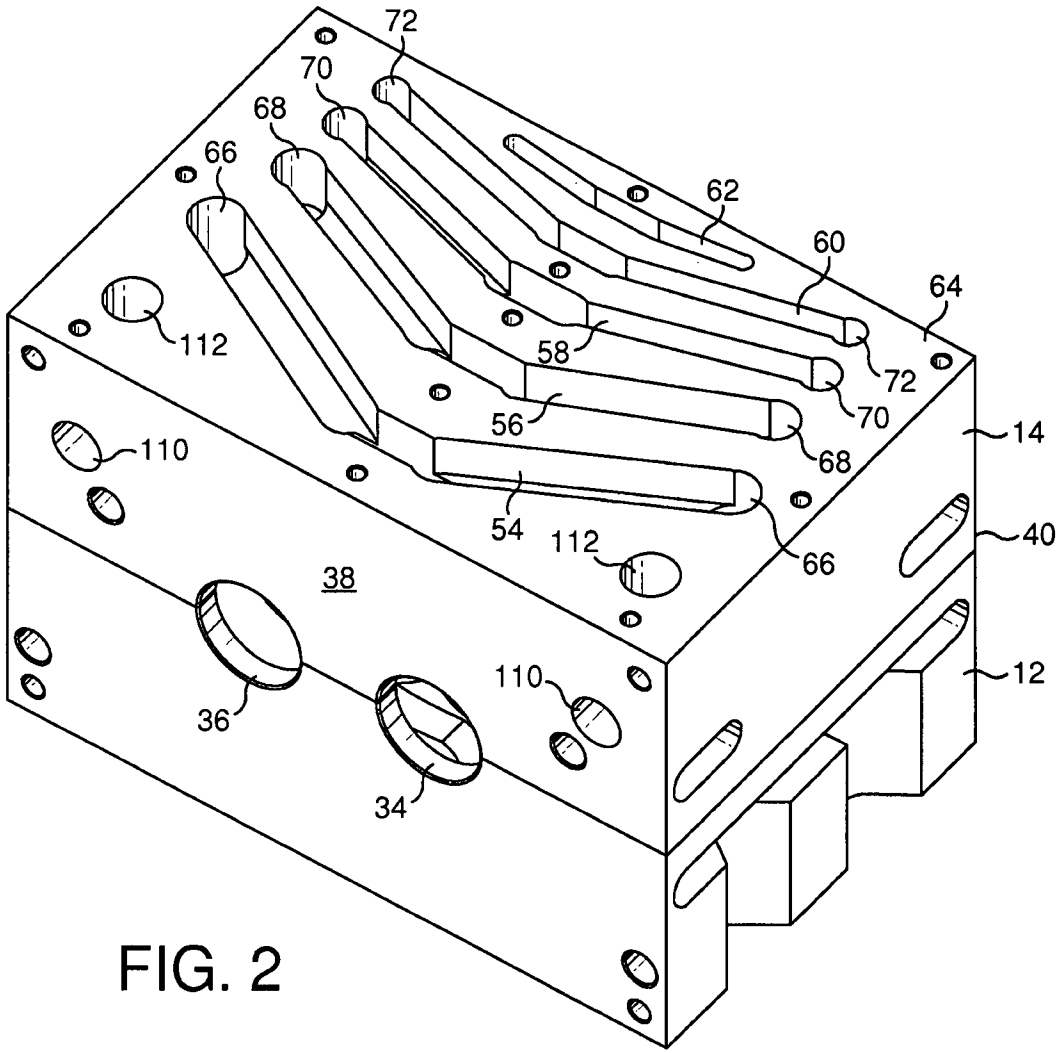
FIG. 2 is another isometric view of the housing of FIG. 1.
Figure 3:
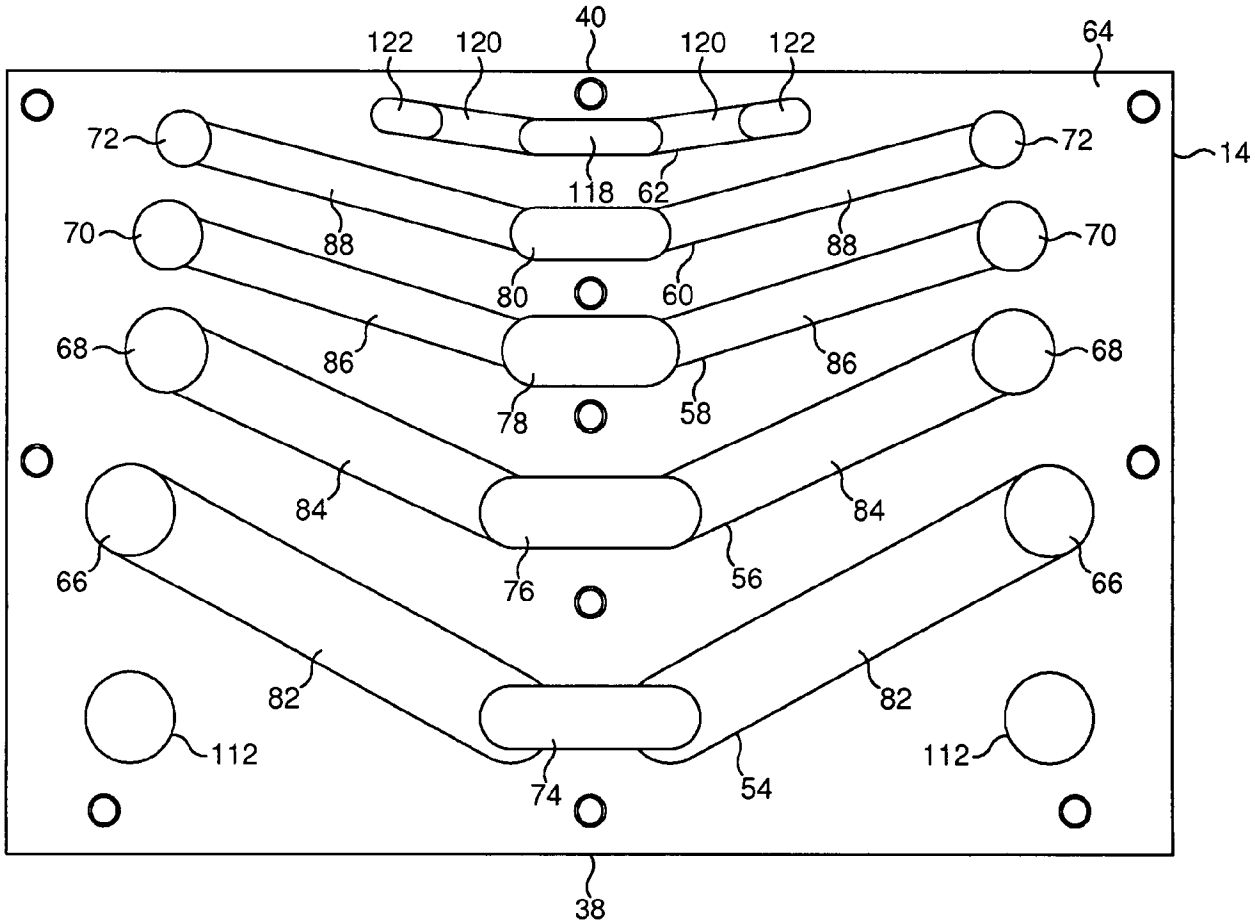
FIG. 3 is a bottom plan view of the housing of FIG. 1.

The outlet ports 54, 56, 58 and 60 of the pumping chambers 16, 18, 20 and 22 are thus shaped to convey pumped fluid into the transfer channels 66, 68, 70 and 72 respectively. As illustrated in FIGS. 2 and 3, these outlet ports may have a herringbone-type shape, each comprising a first portion 74, 76, 78 and 80 for receiving pumped fluid from its respective pumping chamber, and two second portions 82, 84, 86, 88, each extending at an angle from the first portion, for conveying pumped fluid to a respective transfer channel 66, 68, 70, 72. The second portions are each in the form of slots or grooves formed in the end surface 64 of the second stator component 14.

Figure 4:
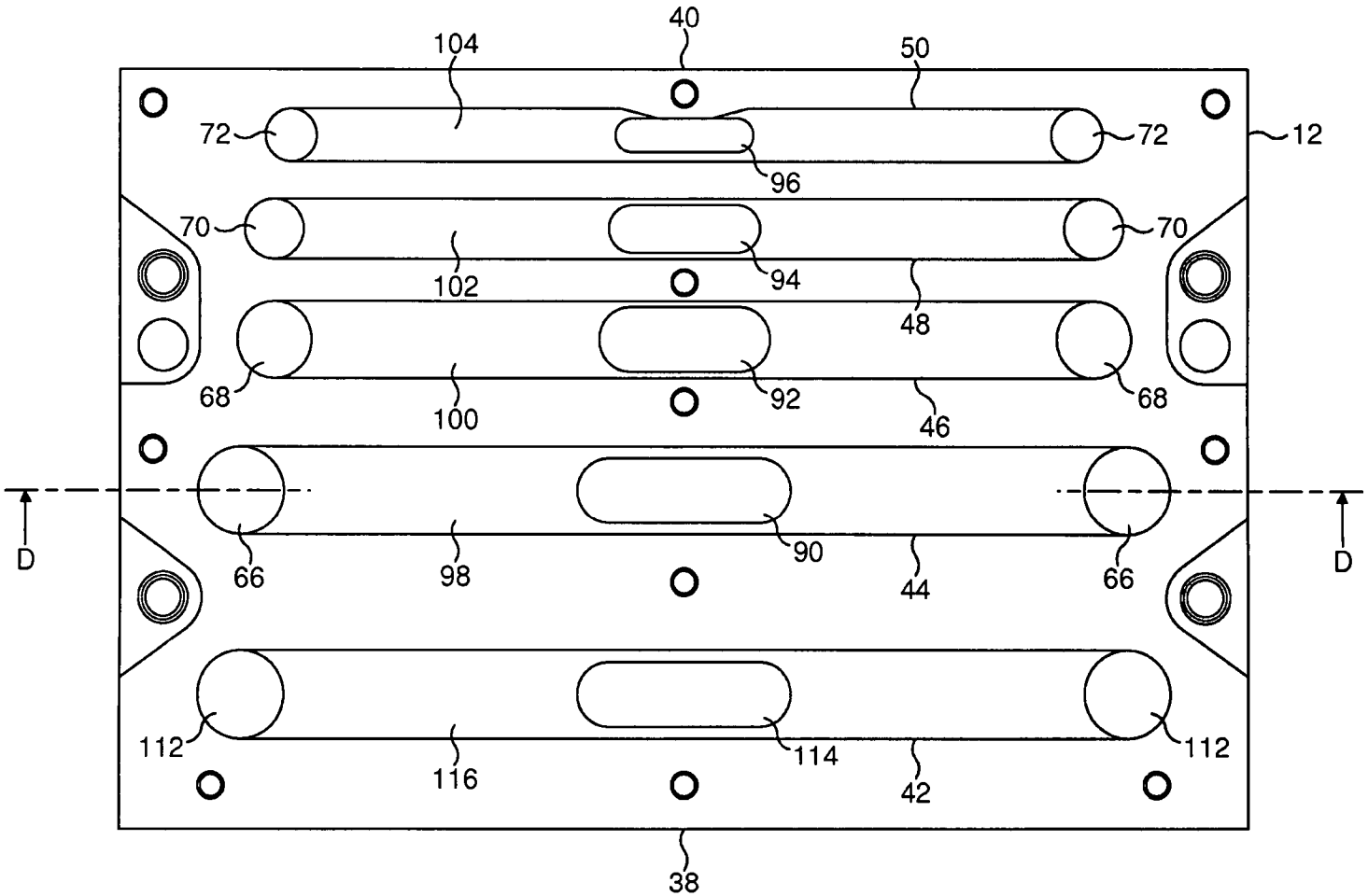
FIG. 4 is a top plan view of the housing of FIG. 1.

The inlet ports 44, 46, 48 and 50 of the pumping chambers 16, 18, 20 is 22 are shaped to receive fluid from a respective transfer channel 66, 68, 70 and 72 and to convey the received fluid into their respective pumping chamber. With reference to FIGS. 1 and 4, each of these inlet ports comprises a first portion 90, 92, 94 and 96 for conveying fluid into its respective pumping chamber, and a second portion 98, 100, 102 and 104 for conveying fluid from a respective transfer channel 66, 68, 70, 72 to its first portion. In this example, the second portions of these inlet ports are in the form of slots or grooves formed in the top external surface 52 of the first stator component 12, each slot being arranged substantially parallel to the pumping chambers and extending along a substantial part of the width of the housing 10.

Fluid enters the housing 10 through pump inlet ports 110 located in the end surface 38 of the stator components 12, 14. Fluid transfer channels 112 extending substantially orthogonal to the external surfaces 52, 64 of the stator components 12, 14 and on opposite sides of pumping chamber 16 receive fluid from the pump inlet ports 110 and convey fluid to the inlet port 42 of pumping chamber 16. Inlet port 42 is arranged similar to the other inlet ports, in that inlet port 42 comprises a first portion 114 for conveying fluid into its respective pumping chamber 16, and a second portion 116 for conveying fluid from the transfer channels 112 to its first portion 114.

Fluid leaves the housing through pump exhaust ports (not shown) located in the end surface 40 of the stator components 12, 14. The outlet port 62 of pumping chamber 24 comprises a first portion 118 for receiving pumped fluid from pumping chamber 24, and two second portions 120 for conveying pumped fluid to transfer channels 122, which in turn convey the pumped fluid to the pump exhaust ports.

As the pumping chambers 16, 18, 20, 22, 24 may have various different sizes and/or thicknesses, the inlet and outlet ports of the chambers may have various different shapes. For example, as illustrated in FIG. 3, the first portions of the outlet ports may have respective different lengths and/or widths, and the second portions of the outlet ports may each have respective different lengths, widths and/or angles to their respective first portion. Similarly, as illustrated in FIG. 4, the first and second portions of the inlet ports may have respective different lengths and/or widths. As also illustrated in these two figures, the transfer channels 66, 68, 70 and 72 may have also respective different shapes.

Figure 6:
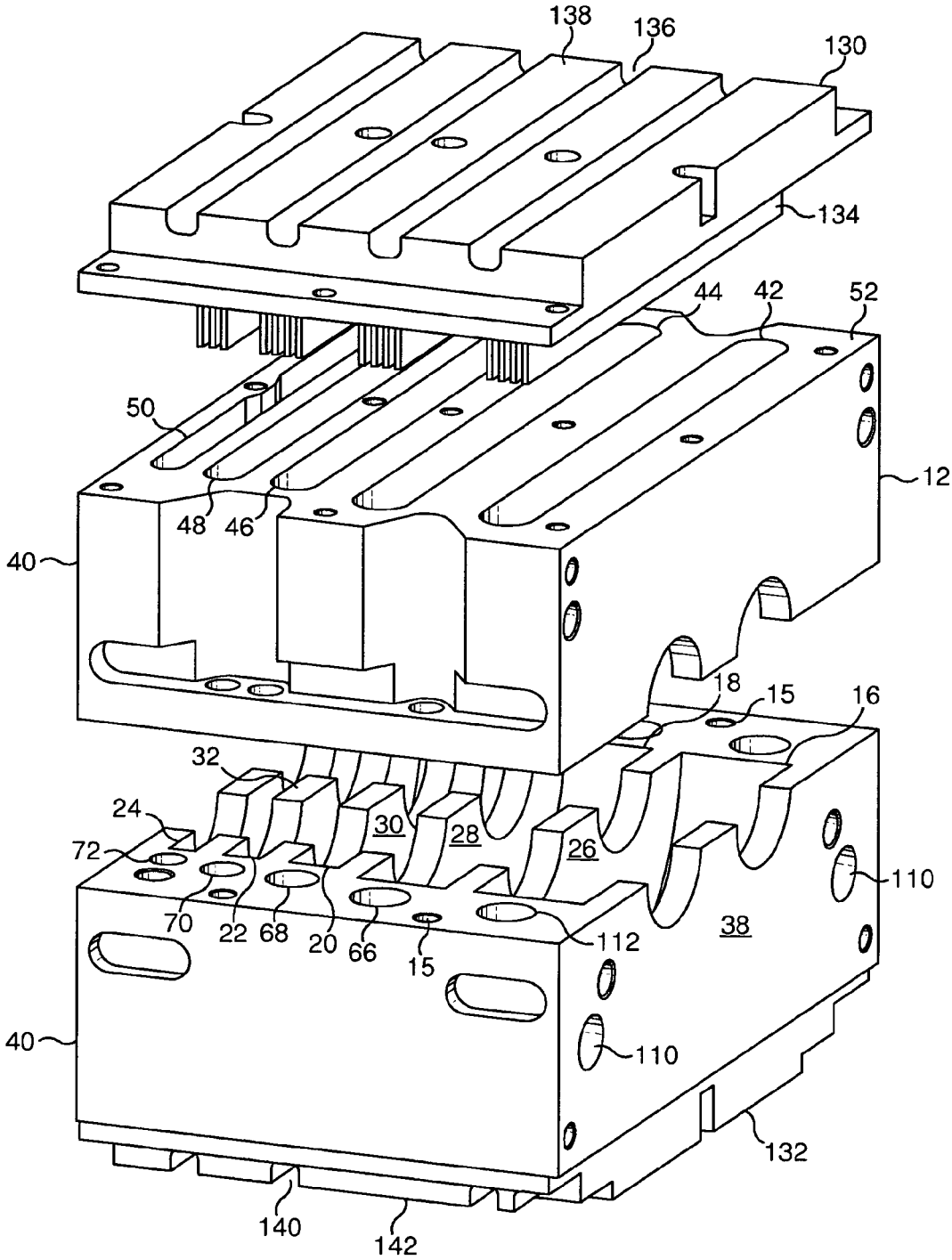
FIG. 6 is an exploded view of the vacuum pump housing of FIG. 1 illustrating cover plates for closing the inlet and ports of the housing.

With reference now to FIG. 6, the inlet ports are closed by a first cover plate 130 mounted on the top external surface 52 of the first stator component 12, and the outlet ports are closed by a second cover plate 132 mounted on the bottom external surface 64 of the second stator component 14. These cover plates 130, 132 also serve to close the ends of the transfer channels 66, 68, 70, 72, 112, 122 which are open on these external surfaces 52, 64.

At least one of the cover plates, in this example the first cover plate 130, comprises a plurality of sets of fins 134, each set protruding into a respective inlet port when the cover plate 130 is mounted on the top external surface 52 to contact fluid passing through the housing 10. Each of the cooling fins 134 of a respective set of fins is arranged to extend lengthways in the direction of fluid flow within its respective inlet port. Consequently, as in this example the inlet ports are arranged substantially parallel to the pumping chambers and extend along a substantial part of the width of the housing 10, the fins 134 are similarly arranged substantially parallel to the pumping chambers and extend along a substantial part of the width of the housing 10. This can maximise the surface area of the fins which is exposed to the fluid passing through the pump, and thus maximise heat transfer between the fluid and the fins 134. The fin area, fin shape, fin spacing and/or number of fins of each set may be individually configured to optimise the cooling at each inlet port.

Fins may also be located on the second cover plate 132 for protrusion into the outlet ports when the second cover plate 132 is mounted on the bottom external surface 64 of the second stator component 14. In this case, these fins may comprise a plurality of sets of fins, each set protruding into a respective second portion of an outlet channel and extending substantially parallel to the direction of fluid flow within its respective second portion.

Grooves 136 are formed on the external surface 138 of the first cover plate 130, and grooves 140 are formed on the external surface 142 of the second cover plate 142, for receiving water pipes for conveying a coolant for cooling the fins about the external surfaces of the cover plates 130, 132.

In FIGS. 1 to 6 each transfer channel is arranged in the plane of the pumping chamber to which that transfer channel is conveying fluid. Each transfer channel may alternatively be arranged in the plane of the pumping chamber from which that transfer channel is receiving pumped fluid. In this case, the inlet ports may have a configuration similar to that of the outlet ports illustrated in FIGS. 1 to 6, with the outlet ports having a configuration similar to that of the inlet ports illustrated in FIGS. 1 to 6. As another example, both the inlet and outlet ports may have a configuration similar to that shown in FIG. 4, with the transfer channels extending diagonally (relative to the external surfaces 52, 64 of the stator components 12, 14) from the outlet port of one pumping chamber to the inlet port of another pumping chamber.

It is to be understood that the foregoing represents embodiments of the invention, others of which will no doubt occur to the skilled addressee without departing from the true scope of the invention as defined by the claims appended hereto.

While the foregoing description and drawings represent various embodiments of the present invention, it will be apparent to those skilled in the art that various changes and modifications may be made therein without departing from the true spirit and scope of the present invention.

We claim:

1. A vacuum pump housing comprising first and second half-shell stator components defining a plurality of pumping chambers separated by partition members, a first and a second pumping chamber each comprising an inlet port for receiving fluid and an outlet port through which pumped fluid is exhausted from the chamber, and transfer channels for conveying fluid between the pumping chambers, wherein the inlet ports are open on an external surface of the first stator component, the outlet ports are open on an opposing external surface of the second stator component, and each transfer channel extends within the stator components, bypassing the partition members, from a respective outlet port to a respective inlet port, each transfer channel comprising first and second portions located on opposite sides of the housing.

2. The housing according to claim 1 wherein each transfer channel is located to the side of at least one pumping chamber.

3. The housing according to claim 1 wherein each transfer channel extends between the external surfaces of the stator components from a respective outlet port to a respective inlet port.

4. The housing according to claim 1, wherein each transfer channel is located to the side of a respective pumping chamber, with the inlet ports and exhaust ports being shaped to respectively receive fluid from, and convey fluid into, the transfer channels.

5. A vacuum pump housing comprising first and second half-shell stator components defining a plurality of pumping chambers separated by partition members, a first and a second pumping chamber each comprising an inlet port for receiving fluid and an outlet port through which pumped fluid is exhausted from the chamber, and transfer channels for conveying fluid between the pumping chambers, wherein the inlet ports are open on an external surface of the first stator component, the outlet ports are open on an opposing external surface of the second stator component, and each transfer channel is located at least partially to the side of a respective pumping chamber within the stator components in a manner that the transfer channel bypasses the partition members, the inlet ports and exhaust ports being shaped to respectively receive fluid from, and convey fluid into, the transfer channels.

6. The housing according to claim 5 wherein each transfer channel comprises first and second portions located on opposite sides of its respective pumping chamber.

7. The housing according to claim 5 wherein each transfer channel extends between the external surfaces of the stator components.

8. The housing according to claim 5 wherein each transfer channel extends substantially orthogonally between the external surfaces of the stator components.

9. The housing according to claim 5 wherein each transfer channel is arranged to convey fluid to the inlet port of its respective pumping chamber, the outlet ports being shaped to convey fluid into the transfer channels.

10. The housing according to claim 9 wherein each outlet port comprises a first portion for receiving pumped fluid from its respective pumping chamber, and at least one second portion, extending at an angle to the first portion, for conveying pumped fluid to a respective transfer channel.

11. The housing according to claim 10 wherein the outlet ports have different respective shapes.

12. The housing according to claim 1, wherein the inlet ports comprise slots arranged substantially parallel to the pumping chambers.

13. The housing according to claim 5 wherein each transfer channel is arranged to receive fluid from the outlet port of its respective pumping chamber, the inlet ports being shaped to receive fluid from the transfer channels.

14. The housing according to claim 13 wherein each inlet port comprises a first portion from which fluid enters its respective pumping chamber, and at least one second portion, extending at an angle to the first portion, for receiving fluid from a respective transfer channel.

15. The housing according to claim 14 wherein the inlet ports have different respective shapes.

16. The housing according to claim 1 wherein the outlet ports comprise slots arranged substantially parallel to the pumping chambers.

17. The housing according to claim 1 comprising a first cover plate mounted on the external surface of the first stator component to close the inlet ports, and a second cover plate mounted on the external surface of the second stator component to close the outlet ports.

18. The housing according to claim 17 wherein at least one of the cover plates comprises a plurality of sets of cooling fins, each set protruding into a respective port to contact fluid passing through the pump.

19. A vacuum pump housing comprising first and second half-shell stator components defining a plurality of pumping chambers separated by partition members, a first and a second pumping chamber each comprising an inlet port for receiving fluid and an outlet port through which pumped fluid is exhausted from the chamber, and transfer channels extending within the stator components and bypassing the partition members for conveying fluid between the pumping chambers, wherein the inlet ports are open on an external surface of the first stator component, and the outlet ports are open on an opposing external surface of the second stator component, the ports being closed by cover plates mounted on said surfaces, at least one of the cover plates comprising a plurality of sets of cooling fins, each set protruding into a respective port to contact fluid passing through the pump.

20. The housing according to claim 19 wherein each set of cooling fins protrudes into a respective inlet port.

21. The housing according to claim 19 wherein each set of cooling fins protrudes into a respective outlet port.

22. The housing according to claim 19 wherein the cooling fins arranged substantially parallel to the pumping chambers.

23. The housing according to claim 19 wherein each cover plate comprises a plurality of sets of cooling fins, each set protruding into a respective port to contact fluid passing through the pump.

24. The housing according to claim 19 comprising means for cooling the cover plates.

25. The housing according to claim 24 wherein the cooling means comprises one or more pipes for conveying a coolant about the cover plate.

26. The housing according to claim 5 wherein the outlet ports comprise slots arranged substantially parallel to the pumping chambers.

27. The housing according to claim 5 comprising a first cover plate mounted on the external surface of the first stator component to close the inlet ports, and a second cover plate mounted on the external surface of the second stator component to close the outlet ports.

* * * * *